US005417439A

United States Patent [19]

Bickel

[11] Patent Number: 5,417,439

[45] Date of Patent: May 23, 1995

[54] NOCK ADAPTER

[76] Inventor: Wayne J. Bickel, Rte. 1, Box 241, Geneva, Ind. 46740

[21] Appl. No.: 798,018

[22] Filed: Nov. 20, 1991

Related U.S. Application Data

[63] Continuation of Ser. No. 667,884, Mar. 12, 1991, abandoned, which is a continuation of Ser. No. 529,233, May 25, 1990, Pat. No. 5,067,731.

[51] Int. Cl.[6] ..... F42B 6/06

[52] U.S. Cl. ..... 273/416

[58] Field of Search ..... 273/416, 419–422

[56] References Cited

U.S. PATENT DOCUMENTS

| | | | |
|---|---|---|---|
| 1,423,551 | 7/1922 | Adriance | 273/419 |
| 1,794,051 | 2/1931 | Allen | 273/416 |
| 2,747,876 | 5/1956 | Teller | 273/420 |
| 3,393,912 | 7/1968 | DeLonais | 273/418 |
| 4,050,696 | 9/1977 | Troncoso, Jr. | 273/420 |
| 4,141,554 | 2/1979 | Sherwin | 273/416 |
| 4,305,588 | 12/1981 | Dodge | 273/416 |
| 4,533,146 | 8/1985 | Schaar | 273/422 |
| 4,544,163 | 10/1985 | Scanion | 273/416 |
| 4,547,837 | 10/1985 | Bennett | 362/186 |
| 4,645,211 | 2/1987 | Beiter | 273/416 |
| 4,671,517 | 9/1987 | Winters | 273/421 |
| 4,709,965 | 11/1987 | Schaar | 273/416 |
| 4,874,180 | 10/1989 | Fingerson et al. | 273/416 |
| 4,943,067 | 7/1990 | Saunders | 273/416 |
| 5,067,731 | 11/1991 | Bickel | 273/416 |

FOREIGN PATENT DOCUMENTS

| | | | |
|---|---|---|---|
| 1470802 | 4/1977 | United Kingdom | 273/416 |
| WO8903012 | 4/1989 | WIPO . | |

OTHER PUBLICATIONS

Micro-Flite Nock Taper Insert. Archer's Bible 1966–67 p. 74 Mar. 1967.

The Archery Sport Shop Catalog, 9th Ed. 1987–1988.

*Primary Examiner*—Paul E. Shapiro

*Attorney, Agent, or Firm*—Baker & Daniels

[57] ABSTRACT

The present invention is a nock adapter for mounting a nock to an arrow shaft. The nock adapter has holes at each end for engaging a shaft and a nock, respectively. In one form, the present invention fits within the arrow shaft and is capable of mounting a standard nock on its tapered mounting surface, or an A.C.E. nock which engages a bore of the nock adapter. In another form, the present invention receives the shaft of an arrow at one end and receives an A.C.E. nock at the other end, while having a generally cylindrical outer surface for streamlining the flight of the arrow. The nock adapter is preferably made of aluminum for its structural rigidity and light weight.

5 Claims, 2 Drawing Sheets

NOCK ADAPTER

CROSS-REFERENCE TO RELATED CASES

This application is a continuation of application Ser. No. 07/667,884, filed Mar. 12, 1991, now abandoned, which is a continuation of application Ser. No. 07/529,233, filed May 25, 1990, now U.S. Pat. No. 5,067,731.

BACKGROUND OF THE INVENTION

The present invention relates to nock assemblies for arrows. More specifically, the field of the invention is that of nock adapters for arrows.

Arrows consist of three basic varieties of shafts: aluminum, carbon, and aluminum-carbon. Each variety has a number of different sizes, all with common problems which are inherently involved in mounting nocks. Also, the cost of the arrow shaft is significantly greater than the cost of a nock, so protecting the shaft has considerable importance in the archery art.

About 50 different sizes of aluminum arrows are commonly used. Typically, the shaft of an aluminum arrow is a cylindrical tube with an inner bore and a relatively thin rigid outer wall. On prior art aluminum arrows, an end portion of the arrow is tapered by swedging to produce a 11½° tapered nock mounting surface for supporting a nock attached thereto by adhesive. However, swedging produces a tapered surface which is often off-center or split and thus causes problems in the performance of the arrow such as erratic flight paths. Also, swedging is a relatively expensive operation which creates a significant amount of scrap.

To avoid swedging, prior art nock adapters are provided for insertion into a hollow end of an arrow to provide a nock mounting surface. One such nock adapter is described in co-pending application "Nock Insert For An Arrow", Ser. No. 463,894, the disclosure of which is expressly incorporated by reference herein. These prior art adapters are well suited for mounting standard nocks on aluminum arrows, but are not suited for some other arrow types such as carbon or aluminum carbon arrows.

About 12 to 15 different sizes of carbon arrows are common. Typically, the shaft of a carbon arrow is cylindrical and has a relatively small outer diameter as compared to aluminum arrows. A suitable nock mounting system has not yet been developed for the carbon shaft arrow. On prior art carbon arrows, a plastic nock with an inner bore larger in diameter than the outer diameter of the carbon arrow is fitted over the carbon arrow shaft. Alternately, a metal nock adapter cap with an adhesively attached nock is fitted over the carbon arrow shaft. However, the larger nock creates turbulence because of its expanded outer diameter. Turbulence is undesired because it interferes with the accuracy and speed of the arrow's flight.

About 9 or 10 different sizes of aluminum-carbon arrows are common. Typically, the shaft of an aluminum-carbon arrow includes an inner cylindrical aluminum portion with a carbon wrap on the outside thereof. Aluminum carbon arrows typically have an outer diameter between the sizes of aluminum and carbon arrows. The aluminum-carbon arrow has the advantages of the light weight of carbon and the structural rigidity of aluminum. However, mounting a standard nock on the end of an aluminum-carbon arrow involves the same problems as with the above identified other types of prior art arrows. Am A.C.E. nock which fits within the inner diameter of the shaft is available for one size of aluminum-carbon arrow, however the A.C.E. nock is only adapted for fitting within one specific shaft size.

A problem associated with all three types of arrows involves situations when an arrow strikes the back end of another arrow, which is sometimes referred to as a robin hood shot. A robin hood shot often damages or destroys the nock and splits the arrow shaft. With a plastic nock, a robin hood shot usually destroys the nock and damages the arrow. With a plastic nock and metal adapter, a robin hood shot usually destroys the nock with the adapter and shaft absorbing the force of the oncoming arrow, which may still damage the arrow depending on the force of the blow and the strength of the adapter. Any damage to the arrow shaft should be avoided because of their relatively high cost in comparison with the nock.

Another problem in the archery art is that all of the above mentioned arrow types needs a particular size of nock. This requires that numerous types of nocks be provided which may not be optimal or even compatible to more than one size arrow. Nocks are broken more frequently than nock adapters, so large volumes of inventory are required to adequately stock nocks for the various arrow sizes.

What is needed is a nock adapter which is smaller in size to reduce the drag on the arrow. Also what is needed is a low weight nock adapter capable of providing a nock mount for all the various available arrow sizes which is adapted to mount at least one of the standard or A.C.E. nock. A further need exists for a nock adapter which allows for easier attaching and detaching of the nock. Yet another need exists for a nock adapter which minimizes damage from robin hood shots.

SUMMARY OF THE INVENTION

The present invention provides a nock adapter which overcomes the above identified problems. The nock adapter of the present invention has a body with a central through aperture and two ends. One end of the adapter engages the arrow shaft, and the other end of the adapter engages the nock. The nock adapter is streamlined to improve accuracy, and the central through aperture aids in reducing the weight of the adapter. Also, the adapter is made from a light-weight and structurally rigid material such as aluminum to protect the attached arrow from robin hood shots.

The present invention accommodates many different sizes of arrows and provides a mounting area for both standard and A.C.E. nocks. With arrows having shafts with relatively large outer diameters, such as aluminum or aluminum-carbon arrows, one embodiment of the nock adapter of the present invention has a tapered mounting surface which extends to an end having a nock bore. The tapered mounting surface, which may include glue grooves, is adapted to engage an inner mounting surface of a standard nock. The nock bore is adapted to receive the stem of an A.C.E. nock. The standard nock can be conveniently mounted because of the tapered mounting surface of the adapter, and the A.C.E. nock can be easily inserted into the nock bore. With arrows having shafts with a relatively small outer diameter, such as carbon arrows, another embodiment of the nock adapter of the present invention has inner bores for respectively receiving both the arrow shaft and the A.C.E. nock.

The streamlined external surface of the nock adapter reduces drag and turbulence thus making the flight of the attached arrow more accurate. For larger arrows, the nock adapter has a smooth outer surface which starts at about the outer diameter of the shaft and tapers down to abut the nock. With smaller arrows, one end of the adapter receives the shaft and the other end receives the nock and the external surface of the adapter is generally cylindrical including a forward portion which tapers down to the outer diameter of the shaft.

Both the structure and material of the nock adapter minimize the weight of the nock adapter. The body of the nock adapter includes a central through aperture which reduces the amount of material. The aluminum body of the nock adapter satisfies two criteria: relatively low weight and relatively high structural rigidity.

When a robin hood shot occurs, one arrow may go inside the other arrow. To minimize the damage from a robin hood shot, the nock adapter of the present invention has a strong, structurally secure aluminum body which can absorb the force of a robin hood shot without effecting the attached shaft. A plastic nock or nock adapter is more likely to splinter and permanently attach to the shaft, ruining the shaft for use with other nocks or adapters. With the present invention, even if the force of the robin hood shot damages the nock adapter, it can be easily removed from the shaft by melting the adhesive bonding the shaft and adapter.

The present invention is, in one form, an arrow assembly including a shaft, nock, and nock adapter. The shaft has two ends, and the nock adapter has a body with a central through aperture. A first end of the nock adapter includes means for engaging the shaft. A second end of the nock adapter includes means for engaging the nock.

The present invention is, in another form, a nock adapter for connecting an end of an arrow shaft to a nock. The nock adapter has a shaft end, a nock end, and a body. The body includes a central through aperture extending from the shaft end to the nock end, a first means for attaching the nock adapter to the arrow shaft, and a second means for attaching the nock adapter to the nock.

The present invention is, in a further form, a nock adapter comprising a body with an arrow end and a nock end. The arrow end has means for engaging a shaft which includes a first hole. The nock end has means for engaging a nock which includes a second hole.

One object of the present invention is to provide a nock adapter which is smaller in size and reduces the drag on the arrow.

An object of the present invention is also to provide a nock adapter which allows the arrow to fly accurately and precisely.

Another object is to provide a low weight nock adapter which is capable of providing a nock mount for all the various available arrow sizes.

A further object is to provide a nock adapter which can mount either one of the standard or A.C.E. nock.

An additional object is to provide a nock adapter which allows for easier attaching and detaching of the nock.

Yet another object is to provide a nock adapter which minimizes damage from robin hood shots.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DESCRIPTION OF THE PREFERRED EMBODIMENT

Figure 9:
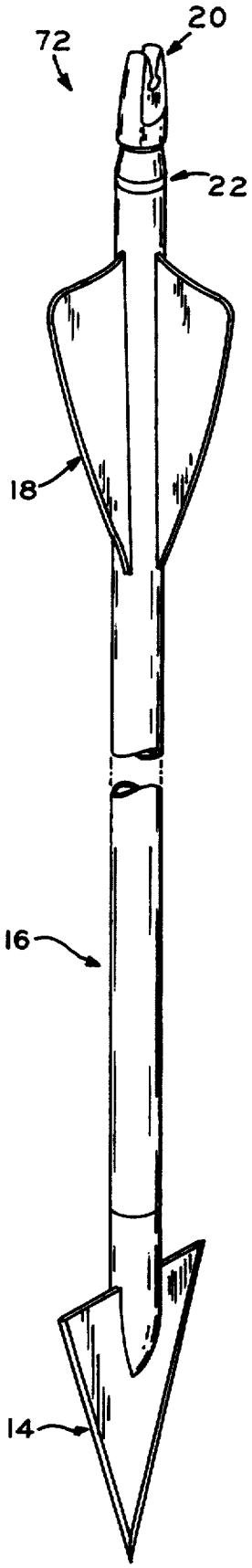
FIG. 9 is a perspective view of an arrow with the nock adapter of FIG. 1 and a standard nock.
Figure 10:
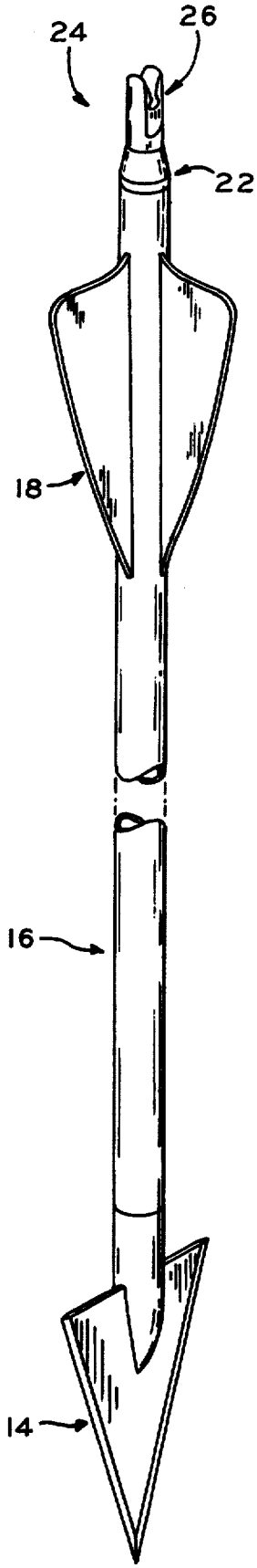
FIG. 10 is a perspective view of an arrow with the nock adapter of FIG. 1 and an A.C.E. nock.

The present invention relates to nock adapters for attaching nocks to arrow shafts. One embodiment is designed for use with larger arrow shafts as shown in FIGS. 9 and 10. FIG. 9 depicts arrow 12 which includes arrowhead 14, aluminum shaft 16, feathers 18, standard nock 20, and nock adapter 22 of the present invention. FIG. 10 depicts arrow 24 which includes arrowhead 14, aluminum shaft 16, feathers 18, A.C.E. nock 26, and nock adapter 22 of the present invention. Aluminum shaft 16 could also be an aluminum-carbon shaft. Nock adapter 22 is shown in greater detail in FIGS. 1-6.

In accordance with the present invention, adapter 22 has a body 28 made of a suitable lightweight, strong material such as graphite or, as in the preferred embodiment, aluminum. Body 28 includes an arrow engaging portion 30, which defines arrow bore 32, and a nock engaging portion 34, which defines nock bore 36. Central through aperture 38 extends within body 28, which also includes a shoulder portion 40 located at the interface of portions 30 and 34.

Figure 1:
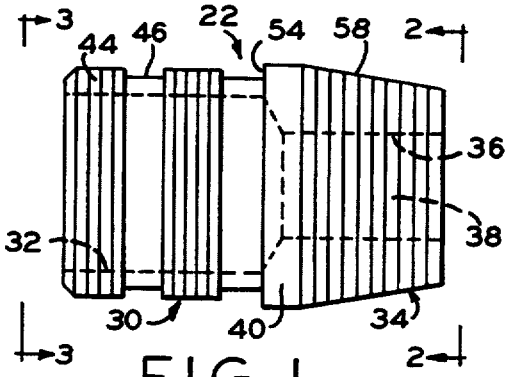
FIG. 1 is a side elevational view of a nook adapter of the present invention.
Figure 2:
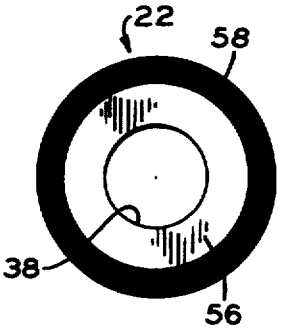
FIG. 2 is a rear view of the nock adapter taken along view line 2—2 of FIG. 1.
Figure 3:
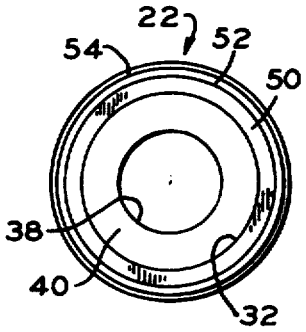
FIG. 3 is a front view of the nock adapter taken along view line 3—3 of FIG. 1.
Figure 4:
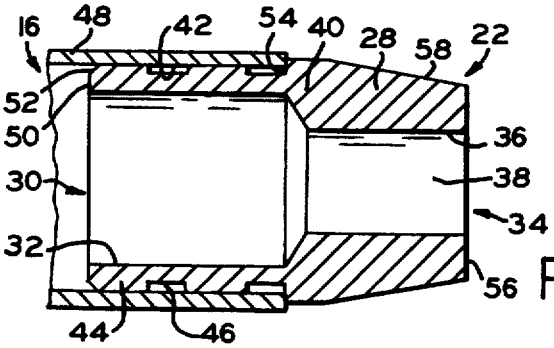
FIG. 4 is a side view, in cross section, of the nook adapter of FIG. 1 engaged with an arrow shaft end.

Arrow engaging portion 30 fits within axial hollow 42 of the butt of shaft 16 (see FIG. 4). Alternating ribbed portions 44 and adhesive grooves 46 of portion 30 engage the interior surface of wall 48 of shaft 16. A suitable adhesive can be put in grooves 46 to bond adapter 22 to shaft 16. The outer end of arrow engaging portion 30 includes annular face 50 and a tapered portion 52 (see FIG. 3). Also, shoulder portion 40 has an outer rim 54 which extends beyond the periphery of ribbed portions 44 to serve as a stop for shaft 16. Adapter 22 is easily positioned within hollow 42 because tapered portion 52 aids in inserting adapter 22 and rim 54 fixes the position of shaft 16.

Figure 5:
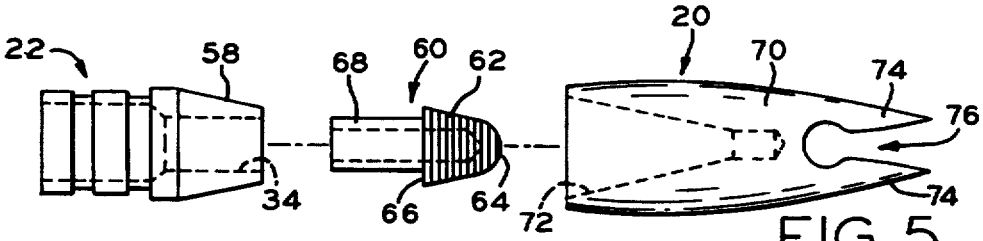
FIG. 5 is an exploded view of a nock assembly with the nock adapter of FIG. 1.
Figure 6:
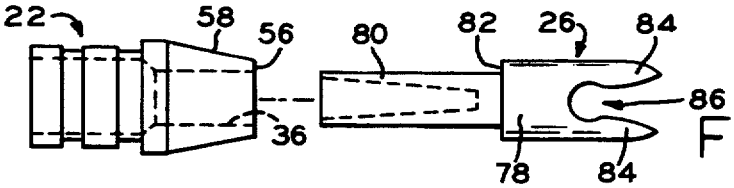
FIG. 6 is an exploded view of an alternate form of a nock assembly with the nock adapter of FIG. 1.

Nock engaging portion 34 is adapted to mount either standard nock 20 (FIG. 5) or A.C.E. nock 26 (FIG. 6). Nock bore 36 extends axially through frusto-conical nock engaging portion 34 from shoulder portion 40 to nock face 56. Tapered external surface 58 of nock engaging portion 34 provides a tapered mounting surface which is preferably oriented at a 11½° angle for engaging standard nock 20. Also, surface 58 may be grooved to facilitate the deposit of adhesive and to create an interference fit with standard nock 20.

To mount standard nock 20 as shown in FIG. 5, adapter extension 60 may be used to increase the amount of mounting surface available. External tapered mounting surface 62 extends from rounded tip 64 to shoulder 66 of adapter extension 60. Stem 68 of adapter extension 60 fits securely within nock bore 36 and causes mounting surfaces 58 and 62 to form a generally continuous mounting surface. Standard nock 20 includes a body 70 having an internal mounting surface 72 and nock wings 74 which define furrow 76. Mounting surfaces 58 and 62 preferably have the same angular orientation, which also preferably matches the internal angle of internal mounting surface 72. When fully assembled, internal mounting surface 72 engages a substantial portion of external mounting surfaces 58 and 62 wherein nock body 70 extends completely over adapter extension 60 and over a majority of the axial length of nock engaging portion 34.

To mount A.C.E. nock 26 as shown in FIG. 6, one end of body 78 has nock stem 80. When fully assembled, nock stem 80 extends through nock bore 36 and nock shoulder 82 abuts nock face 56. The outer diameter of shoulder 82 is approximately the same as the outer diameter of nock face 56 to provide a streamlined outer surface. At the other end of body 78, nock wings 84 extend rearwardly from shoulder 82 to define furrow 86.

Figure 7:
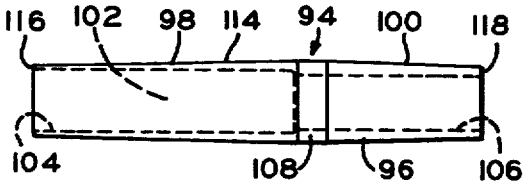
FIG. 7 is a side elevational view of an alternate form of the nock adapter of the present invention.
Figure 8:
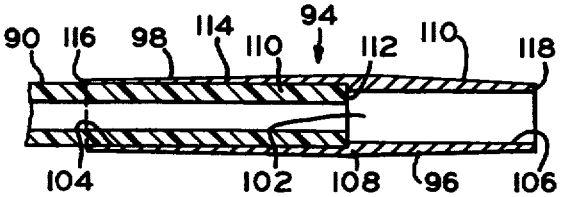
FIG. 8 is a side elevational view, in partial cross section, of the nock adapter of FIG. 7 engaged with a carbon arrow shaft.
Figure 11:
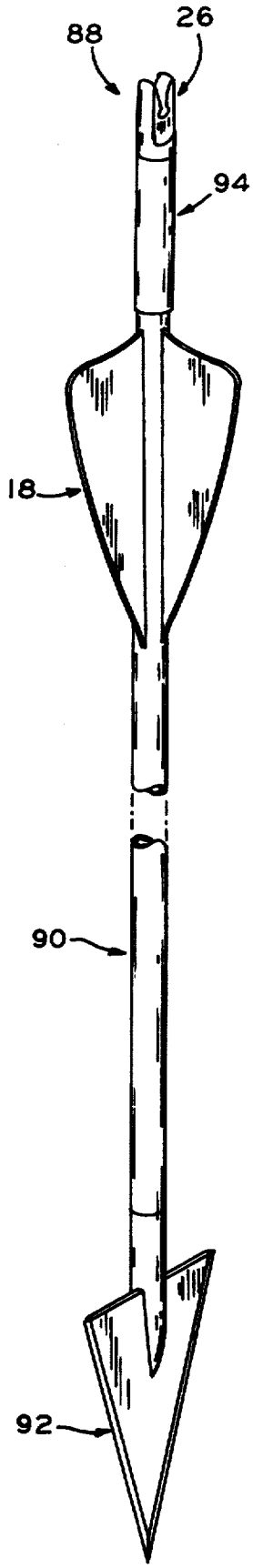
FIG. 11 is a perspective view of an arrow with the nock adapter of FIG. 7 and an A.C.E. nock.

An alternate embodiment of the present invention is shown in FIGS. 7, 8, and 11. Carbon arrow 88 of FIG. 11 includes shaft 90, arrowhead 92, feathers 18, A.C.E. nock 26, and nock adapter 94. Carbon arrows are well known in the archery art, however a satisfactory nock mounting system is needed.

In accordance with the present invention, body 96 of nock adapter 94 engages carbon shaft 90 at shaft engaging portion 98, and engages A.C.E. nock 26 at nock engaging portion 100. Central through aperture 102 extends axially through nock adapter 94 and includes shaft bore 104 and nock bore 106. Shoulder portion 108 is located intermediate engaging portions 98 and 100 at the interface of bores 104 and 106.

Shaft engaging portion 98 receives shaft wall 110 in shaft bore 104, and end 112 of wall 110 abuts shoulder portion 108. Outer surface 114 of shaft engaging portion 98 tapers forwardly, i.e. has increasingly smaller diameters going from shoulder portion 108 to shaft end 116, from the outer diameter of shoulder portion 108 to approximately the outer diameter of wall 110. The diameter of shaft engaging portion 98 is relatively small, for example, with a carbon shaft having a diameter of approximately 0.214 inches the diameter of shaft bore 104 is approximately 0.215 inches and the diameter of shaft engaging portion 98 tapers from approximately 0.247 inches adjacent to shoulder portion 108 to approximately 0.225 inches at shaft end 116 adjacent wall 110.

Nock engaging portion 100 receives nock stem 80 in nock bore 106, and nock shoulder 82 abuts nock end 118. The outer diameter of nock end 118 is approximately equal to the outer diameter of nock shoulder 82, so that body 96 expands in outer diameter from shaft end 116 to shoulder portion 110, and extends from shoulder portion 110 to nock end 118. If the outer diameters of shoulder portion 108 and nock end 118 are equal, nock engaging portion 100 is generally cylindrical. If unequal, nock engaging portion 100 conically extends from shoulder portion 110 to nock end 118, which may be increasing or decreasing depending on the outer diameter of shoulder portion 110. But for any size carbon arrow, for example carbon arrows with a diameter of ⅛" to ⅜" inches, nock adapter 94 provides a streamlined outer surface which heightens the accuracy of the arrow.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A nock assembly for mounting on a hollow arrow shaft comprising a nock having a nock body and a nock stem, said nock body defining a furrow adapted to receive a bow string, a nock adapter including a nock adapter body having a shaft end and a nock end, said shaft end adapted to be received in the hollow shaft of an arrow, said nock end including a bore in, which said nock stem is received.

2. The nock assembly of claim 1 wherein said nock end includes an external tapered nock mounting surface.

3. The nock assembly of claim 1 wherein said shaft end includes an outer surface with adhesives retention grooves therein.

4. The nock assembly of claim 1 wherein said nock adapter body includes a through aperture, in communication with said bore, extending from said shaft end to said nock end.

5. The nock assembly of claim 1 including an abutment means on the outer surface of said shaft end for abutting the end of an arrow shaft.

* * * * *